US006584661B2

(12) United States Patent
Suzuki et al.

(10) Patent No.: US 6,584,661 B2
(45) Date of Patent: Jul. 1, 2003

(54) HEMMING MACHINE

(75) Inventors: Kazumoto Suzuki, Nagoya Aichi (JP); Hideyoshi Arakawa, Aichi (JP)

(73) Assignee: Kabushiki Kaisha Takatsu Seisakusho, Aichi (JP)

( * ) Notice: Subject to any disclaimer, the term of this patent is extended or adjusted under 35 U.S.C. 154(b) by 0 days.

(21) Appl. No.: 09/938,414

(22) Filed: Aug. 23, 2001

(65) Prior Publication Data

US 2002/0023330 A1 Feb. 28, 2002

(30) Foreign Application Priority Data

Aug. 24, 2000 (JP) ..... 2000-254554
May 30, 2001 (JP) ..... 2001-162757

(51) Int. Cl.[7] ..... B23P 11/00
(52) U.S. Cl. ..... 29/243.5; 29/890
(58) Field of Search ..... 29/243.5, 890, 29/565, DIG. 3, 463, 509, 511, 510, 513, 243.517, 283.5; 72/402, 411

(56) References Cited

U.S. PATENT DOCUMENTS 3,191,414 A * 6/1965 Kollar ..... 72/48
3,276,409 A * 10/1966 Denis ..... 113/54
4,706,489 A * 11/1987 Dacey, Jr. ..... 72/450
5,357,665 A * 10/1994 Fukui et al. ..... 29/243.58
5,457,981 A * 10/1995 Brown et al. ..... 72/451
6,029,334 A * 2/2000 Hartley ..... 29/464

* cited by examiner

*Primary Examiner*—Joseph J. Hail, III
*Assistant Examiner*—Daniel Shanley
(74) *Attorney, Agent, or Firm*—Beyer Weaver & Thomas LLP

(57) ABSTRACT

A hemming machine has a single bending block having a surface for carrying out a preliminary bending process and another surface for carrying out a final bending process, a lower block for placing an outer panel with a flange and a mechanism for moving the bending block. The mechanism moves the upper deck in an arcuate way around a specified axis such that a force with a relatively large horizontal component is applied to the flange of the outer panel when the preliminary bending surface of the bending block bends the flange in the preliminary bending process, and then in another arcuate way around another axis such that a force with a relative large perpendicular component is applied to the flange of the outer panel when the final bending surface of the bending block bends the flange in the final bending process.

8 Claims, 4 Drawing Sheets

HEMMING MACHINE

BACKGROUND OF THE INVENTION

This invention relates to a hemming machine for forming an automobile door, for example, by bending a flange part of an outer panel along its outer periphery towards an inner panel appropriately positioned with respect to it and bonding them together.

Prior art hemming machines of this type are generally provided separately with a preliminary bending block for a preliminary bending process and a final bending block for a final bending process. The preliminary bending block is deployed first to preliminary bend the flange part of the outer panel by a specified angle towards the inner panel. The preliminary bending block is then retracted because it would otherwise be in the way of the next operation. Thereafter, the final bending block is deployed to bend further the preliminary bent flange part of the outer panel until it comes into contact with the inner panel. Provided separately with a block dedicated for carrying out the preliminary bending and another block dedicated for carrying out the final bending which can be independently operated, hemming machines of this type are advantageous in that the preliminary bending and the final bending of the flange part of the outer panel can be both effected in specified ways. On the other hand, there are disadvantages in that two bending blocks are separately required, each requiring its own operating mechanism and hence that the machine as a whole becomes large, its structure becomes complicated and the cost of its production becomes higher.

In view of these problems, Japanese Patent Publications Tokkai 55-122636 and 56-14030 disclosed hemming machines of the type having a single bending block integrating both a preliminary bending surface and a final bending surface, the block being caused to move on an arcuate path around a certain selected axis such that the flange part of the outer panel is initially bent towards the inner panel by a specified angle by the preliminary bending surface at a forward position on the bending block and then until it contacts the inner panel by the final bending surface at a backward position. Requiring only one bending block and one driving mechanism for its operation, hemming machines of this type are advantage in that the machine as a whole can be compactly formed, its structure is simpler and its production cost is lower. With prior art hemming machines of this type, however, it is difficult to apply appropriate compressive forces on the flange part of the outer panel at both times of the preliminary bending and the final bending because both are carried out by moving the same single bending block on an arcuate path around the same axis. Since the flange part on the outer panel is subjected to a force with an inappropriate perpendicular component at the time of its preliminary bending, the rising portion of the flange becomes easily distorted. A force with an unreasonable horizontal component which acts on the flange at the time of its final bending, furthermore, tends to distort the main part of the outer panel.

SUMMARY OF THE INVENTION

It is therefore an object of this invention to provide an improved hemming machine which is compact as a whole, simple in structure, and inexpensive to produce but does not cause distortion of the outer panel at the times of preliminary bending and final bending.

A hemming machine embodying this invention, with which the above and other objects can be accomplished, may be characterized as comprising a single bending block having a surface (herein referred to as "the preliminary bending surface" to be used for carrying out a preliminary bending process) and another surface (herein referred to as "the final bending surface" to be used for carrying out a final bending process), a lower block for placing thereon an outer panel with a flange (with an inner panel positioned on the outer panel) and a mechanism for moving the bending block in an arcuate way around a specified axis such that a force with a relatively large horizontal component is applied to the flange of the outer panel when the preliminary bending surface of the bending block bends the flange in the preliminary bending process, and then in another arcuate way around another axis such that a force with a relatively large perpendicular component is applied to the flange of the outer panel when the final bending surface of the bending block bends the flange in the final bending process.

DETAILED DESCRIPTION OF THE INVENTION

Figure 1:
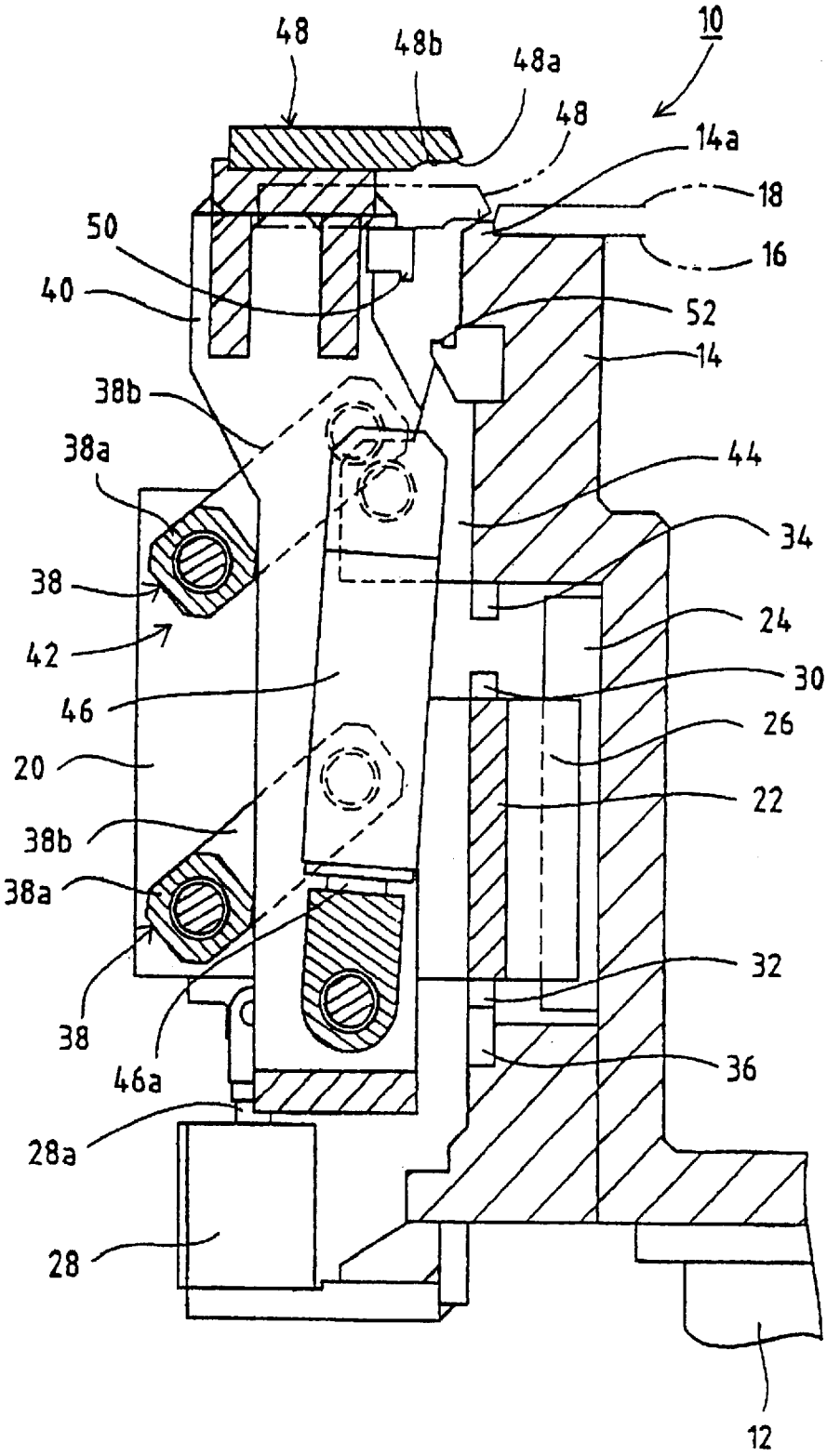
FIG. 1 is a sectional side view of a hemming machine embodying this invention when its mobile frame is positioned for the preliminary bending process.
Figure 4A:
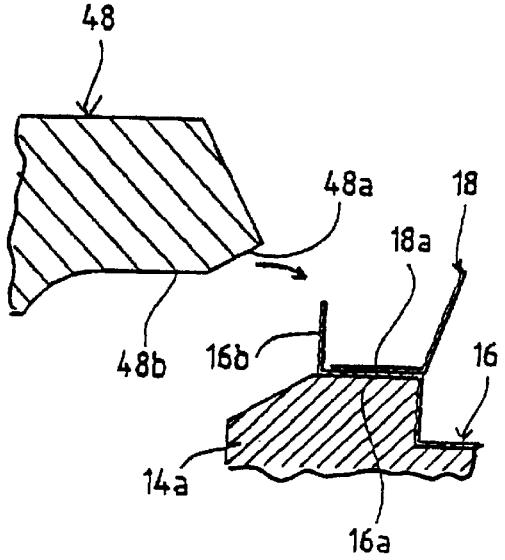
FIGS. 4A, 4B, 4C and 4D, together referred to as FIG. 4, are diagrams for showing the preliminary and final bending processes by the hemming machine of FIGS. 1, 2 and 3.

The invention is described next by way of an example with reference to the drawings. FIG. 1 shows a hemming machine 10 embodying this invention, having a lower block 14 set on a base 12. As shown in FIG. 4, an upper edge part 14*a* of this lower block 14 serves to have placed thereon an outer peripheral part of an outer panel 16 for forming an automobile door. The outer panel 16 has a main body 16*a* and an outer flange 16*b* along its outer periphery, bent approximately perpendicularly therefrom. The outer panel 16 is placed on the lower block 14 such that the outer flange 16*b* extends upward from the main body 16*a,* as shown in FIG. 4A. An inner panel 18, having an inner flange 18*b* bent from its main body along its outer periphery, is positioned on the outer panel such that the open edge of the its inner flange 18*b* is inside the outer flange 16*b,* aligned with the line along which the outer flange 16*b* is bent, as also shown in FIG. 4A.

Figure 2:
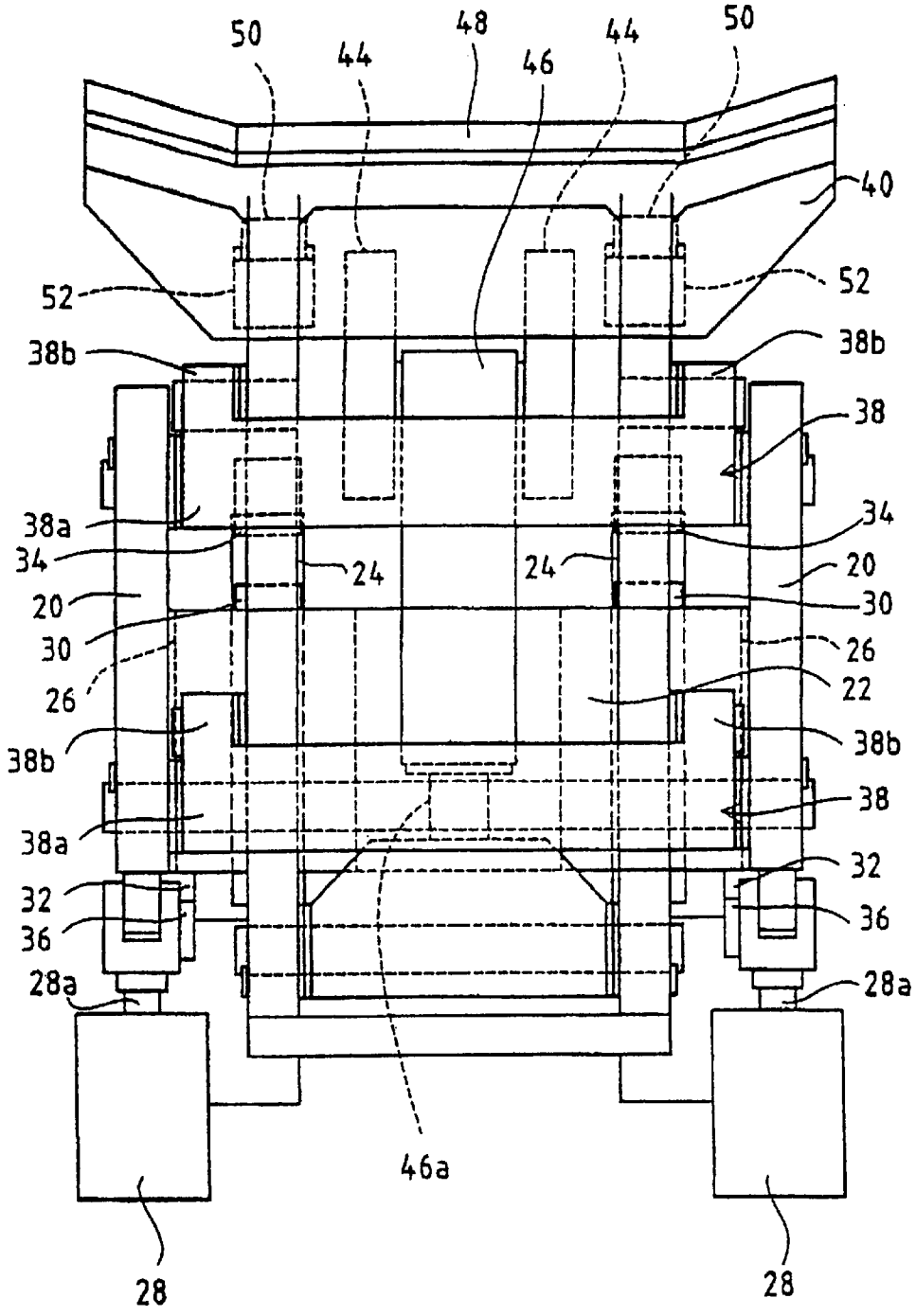
FIG. 2 is a front view of the hemming machine of FIG. 1 after the preliminary bending process has been carried out.

With reference also to FIG. 2, there is a pair of mobile frames 20 separated from each other in the direction of the width of the hemming machine 10 but connected to each other by means of a connector member 22 so as to move as a single unit, both being separated from and on the left-hand side of the lower block 14 with reference to FIG. 1. The connecting member 22 is provided with a pair of sliders 26 each slidably engaging a corresponding one of a pair of vertically extending mutually parallel guide rails 24 attached to an outer side surface of the lower block 14 and mutually separated in the direction of the width of the hemming machine 10. There is a pair of air cylinders 28 each with a piston rod 18*a* which is connected to the bottom of a corresponding one of the mobile frames 20. These air cylinders 28 are operated in synchronism with respect to each other so as to move the mobile frames 20 vertically upward and downward with respect to the lower block 14 along the guide rails 24. The connecting member 22 is provided with upper contact members 30 and lower contact members 32 respectively on its upper and lower surfaces and the lower block 14 is provided with upper stoppers 34 and lower stoppers 36 opposite respectively to the upper and lower contact members 30 and 32, sandwiching the connecting member 22 therebetween. They are designed such that when the air cylinders 28 are operated so as to push the piston rods 28*a* and the mobile frames 20 upward until the upper contact members 30 contact the upper stoppers 36, the mobile frames 20 are at a specified height for the final bending process, as shown in FIG. 3, and that when the air cylinders 28 are operated so as to retract the piston rods 28*a* and to move the mobile frames 20 downward until the lower contact members 32 contact the lower stoppers 36, the mobile frames 20 are at another specified height for the preliminary bending process, as shown in FIG. 1.

A pair of link members 38, vertically separated from each other one above the other, is connected between the pair of mobile frames 20 rotatably around axes 38*a*. Each link member 38 is generally U-shaped with two arm members 38*b* protruding towards the lower block 14 from both ends of its horizontally extending base part 38*a*. The free end of each of these arm members 38*b* is rotatably connected to a holder 40 between the two mobile frames 20 such that the holder 40 will move upward and downward along an arcuate path with respect to the pair of mobile frames 20 by means of a link mechanism 42 consisting of the pair of the aforementioned link members 38. Numeral 46 indicates a hydraulic cylinder with a piston rod 46*a* extending downward, serving as a driving means in vertical directions. The bottom part of this hydraulic cylinder 46 is rotatably supported between a pair of supporting members 44 mutually separated in the direction of the width of the hemming machine 10 on the outer side surface of the lower block 14. The piston rod 46*a* is rotatably connected to a bottom part of the holder 40. At the top of the holder 40 is an bending block 48 which extends towards the lower block 14 by a specified distance. As can be seen in FIGS. 1 and 3, the extended part of the bending block 48 has both a preliminary bending surface 48*a* which faces downward and slopes from the side of the lower block 14 towards the holder 40 by a specified angle and a horizontally extending final bending surface 48*b* behind (on the side of the holder 40 of) the preliminary bending surface 48*a*, also facing downward. In FIGS. 1 and 3, the bending block 48 is shown at its wait position by sold lines. As the hydraulic cylinder 46 is activated, the bending block 48 moves downward to a compressing position indicated by broken lines. During the course of this movement of the bending block 48 from its wait position to its compressing position, the preliminary bending surface 48*a* or the final bending surface 48*b* serves to carry out the preliminary bending process or the final bending process, respectively, on the outer flange 16*b* of the outer panel 16, as more clearly shown in FIG. 4.

Figure 4B:
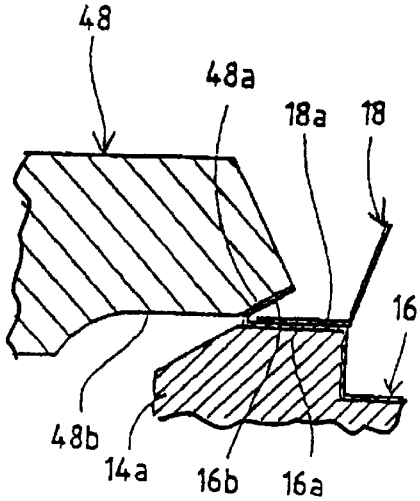

The mobile frames 20 are designed such that the arm members 38*b* are oriented closer to the vertical direction when the bending block 48 is at its wait position for the preliminary bending, as shown in FIG. 1, and that the bending block 48 will move towards the outer flange 16*b* from outside (the left-hand side with respect to the figures) at an angle of about 20–30° with respect to the outer surface of the outer flange 16*b*, thereby bending the outer flange 16*b* by a specified angle such as 45° towards the inner panel 18, as shown in FIGS. 4A and 4B. The positional relationships among the mobile frames 20, the holder 40 and the link mechanism 42 are determined such that the force exerted on the holder 40 when the bending block 48 carries out the preliminary bending of the outer flange 16*b* will be approximately parallel to the line segment connecting the two rotary axes on each link member 38. Thus, the reaction force is directly communicated to and received by the mobile frames 20, and since displacements of the bending block 48 can be prevented, the preliminary bending of the outer flange 16*b* can be accurately carried out.

Figure 3:
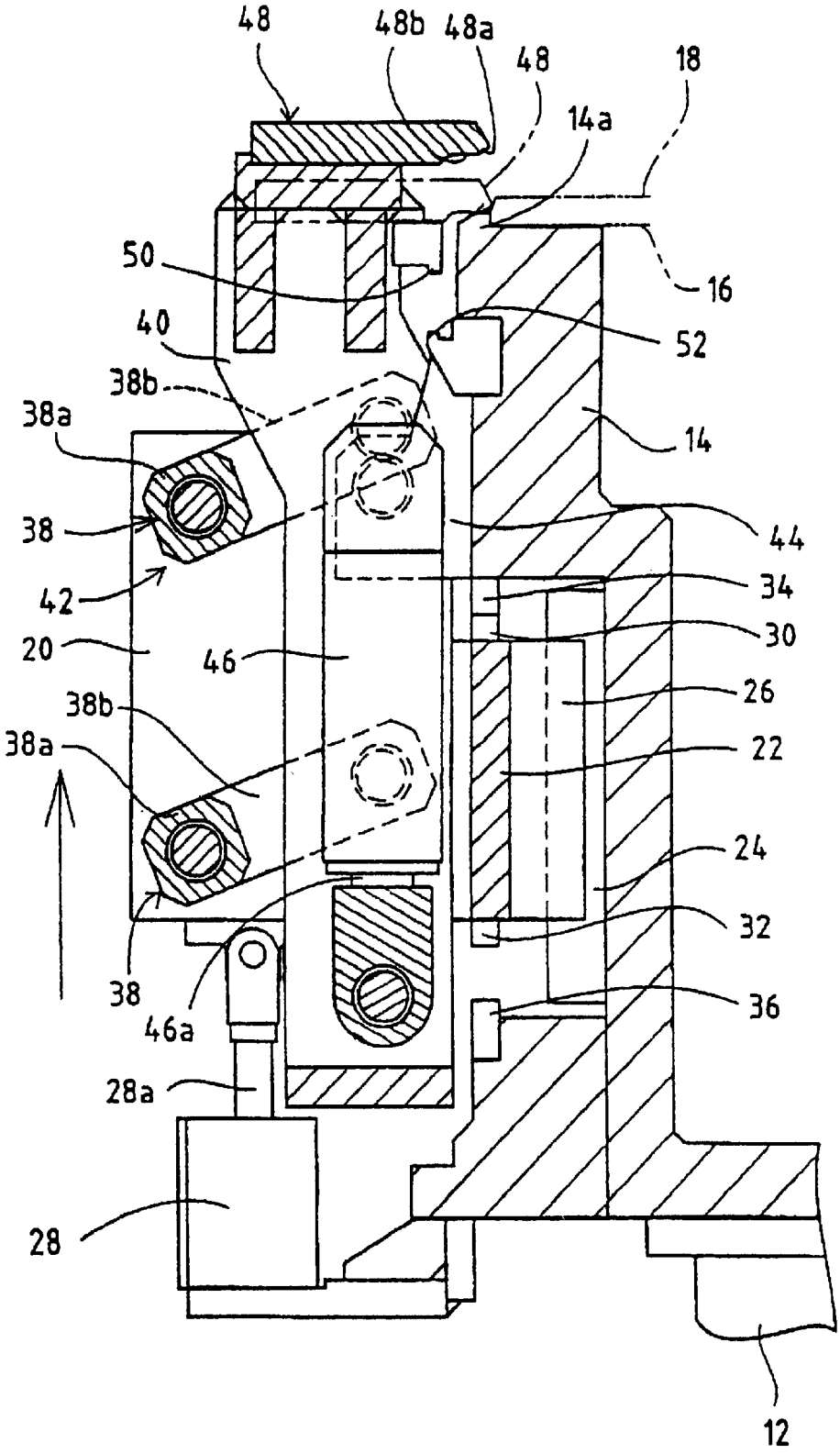
FIG. 3 is another sectional side view of the hemming machine of FIGS. 1 and 2 when its mobile frame is positioned for the final bending process.
Figure 4C:
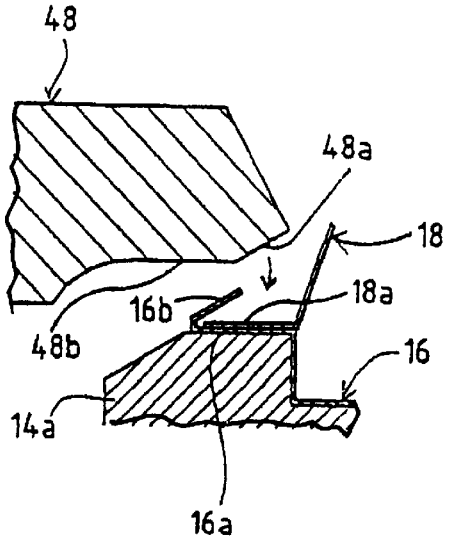
Figure 4D:
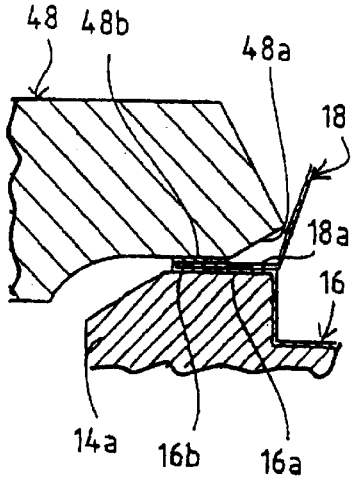

The mobile frames 20 are also designed such that the arm members 38*b* are oriented closer to the horizontal direction when the bending block 48 is at its wait position for the final bending, as shown in FIG. 3, and that the final bending surface 48*b* of the bending block 48 will be above the preliminary bent outer flange 16*b*, as shown in FIG. 4C. From this wait position, the bending block 48 on the holder 40 moves nearly perpendicularly to the outer flange 16*b* until the outer flange 16*b* comes to be pressed against the inner flange 18*a* of the inner panel 18, as shown in FIG. 4D. The positional relationships among the mobile frames 20, the holder 40 and the link mechanism 42 are also determined such that the force exerted on the holder 40 during this final bending process will be in the same direction as that of the force by the hydraulic cylinder 46 (or nearly perpendicular). Thus, displacements of the bending block 48 can be prevented, and final bending of the outer flange 16*b* can be accurately carried out.

The holder 40 is further provided with a contact member 50 and a corresponding stopper 52 is provided on the lower block 14 so as to limit the downward motion of the holder 40 during the preliminary bending process and to thereby prevent the outer flange 16*b* from becoming excessively bent in the preliminary bending process.

Next, the operation of the hemming machine 10 thus structured will be explained. Initially, the mobile frames 20 are in the lowered position, as shown in FIG. 1, and the holder 40 is at the raised wait position on the side of the mobile frames 20.

An outer peripheral part of the outer panel 16 is placed on the upper edge part 14*a* of the lower block 14, and the inner panel 18 is placed on the main body 16*a* of this outer panel 16 such that the inner flange 18*a* of the inner panel 18 reaches the bent line of the outer flange 16*b*. As the hemming machine 10 is started with the inner panel 18 and the outer panel 16 thus set, the hydraulic cylinder 46 pushes down its piston rod 46*a* and the holder 40 is moved downward. In the downward motion, the holder 40 moves in an arcuate manner with respect to the mobile frame 20, moving around the axes 38*a* through the link members 38 such that the preliminary bending surface 48*a* of the bending block 48 contacts the outer flange 16*b* of the outer panel 16 approximately horizontally at a specified angle, applying a force with a relatively strong horizontal component. As a result, the outer flange 16*b* is bent by a specified angle inward, or towards the inner panel 18. The reaction force on the holder 40 during this preliminary bending process is received by the mobile frames 20 through the link mechanism 42 such that the bending block 48 is not subjected to any displacing force in the forward-backward direction or the left-right direction and hence the preliminary bending process can be carried out accurately.

Next, the hydraulic cylinder 46 is operated so as to retract its piston rod 46*a*. After the holder 40 returns to its raised wait position, the air cylinders 28 are activated so as to extend their piston rods 28*a* such that the mobile frames 20 are moved upward vertically to the elevated position for the final bending process, as shown in FIG. 3. In the meantime, the holder 40, connected to the mobile frames 20 through the link mechanism 42, moves in an arcuate manner towards the lower block 14 by a specified distance to the lower forward wait position such that the final bending surface 48*b* of the bending block 48 is above the preliminary bent outer flange 16*b*, as shown in FIG. 4C.

The hydraulic cylinder 46 is activated thereafter to move the holder 40 downward from its wait position shown in FIG. 4C. In this downward motion, the holder 40 moves in an arcuate way with respect to the mobile frames 20 around the axes 38*a* such that the final bending surface 48*b* of the bending block 48 contacts nearly perpendicularly to the preliminary bent outer flange 16*b* of the outer panel 16, applying thereon a force with a relatively large perpendicular component. As the final bending process is thus carried out, the reaction force on the holder 40 is substantially parallel to the direction of the force by the hydraulic cylinder 46. Thus, the bending block 48 is not subjected to any displacing force in the forward-backward direction or the left-right direction and hence the final bending process can also be carried out accurately.

In summary, the hemming machine 10 according to this invention includes mobile frames 20 connected to a holder 40 through a link mechanism 42 and moves the mobile frames 20 between a lower position for the preliminary bending process and a higher position for the final bending process and the holder 40 is moved merely upward and downward in arcuate manners while the mobile frames 20 are in these two positions. As a result, a preliminary bending surface 48*a* of a bending block 48 contacts the outer flange 16*b* in a nearly horizontal direction, applying thereon a force with a relatively large horizontal component for carrying out the preliminary bending process and a final bending surface 48*b* of the bending block 48 subsequently contacts the preliminary bent outer flange 16*b* in an approximately perpendicular direction, applying thereon a force with a relatively large perpendicular component for carrying out the final bending process. Such a hemming machine can be made compact as a whole with a simple structure and its production cost can be reduced while the machine is capable of superior hemming operations without causing distortions on the outer panel at the times of preliminary and final bending processes.

Although the invention has been described above by way of only one example, this example is not intended to limit the scope of the invention. Many modifications and variations are possible within the scope of the invention. For the movements of the mobile frames and the holder, it is not necessary to make use of cylinders, as described above. Use may be made equally well of a combination of pinions and an engaging rack or a combination of mutually engaging bolts and nuts driven by a motor.

When hemming machines of the present invention are used for a hemming operation for the production of an automobile door, a plurality of such hemming machines are usually set so as to surround the flange of an outer panel and each of the hemming machines carries out preliminary and final bending processes on the corresponding part of the flange. Depending on the shape of the door, however, there may be situations of interference among forwardly protruded bending blocks of different ones of the hemming machines if they are operated in synchronism and at the same speed. In order to prevent such occurrences, it is desirable to vary the timing and/or speed of final bending operations.

It goes without saying that hemming machines embodying this invention can be used for the production of not only automobile doors but also fenders and bonnets. They can be used also for the hemming of a panel for many other parts of a machine other than an automobile.

In summary, the present invention provides a hemming machine which can be compact as a whole, is simple in structure, has a reduced production cost and does not cause distortion of the outer panel at the times of preliminary and final bending processes.

What is claimed is:

1. A hemming machine comprising:

a single bending block having thereon a preliminary bending surface and a final bending surface:

a lower block for placing thereon an outer panel with a flange, an inner panel being positioned on said outer panel; and a mechanism for moving said bending block with respect to said lower block, said mechanism moving said bending block in an arcuate way around a first axis such that a force with a relatively large horizontal component is applied to said flange of said outer panel when said preliminary bending surface of said bending block bends said flange in a preliminary bending process, said mechanism moving said bending block in another arcuate way around a second axis different from said first axis such that another force with a relatively large perpendicular component is applied to said flange of said outer panel when said final bending surface of said bending block bends said flange in a final bending process which is carried out subsequent to said preliminary bending process;

wherein said mechanism comprises:

mobile frames;

first driving means for moving said mobile frames vertically with respect to said lower block between an upper position and a lower position;

a holder which is connected to said mobile frames through link members and to which said bending block is attached; and second driving means, operable independently of said first driving means, for moving said holder upward and downward in an arcuate manner with respect to said mobile frames.

2. The hemming machine of claim 1 wherein said mobile frames are at said lower position while said holder is moved for carrying out said preliminary bending process and at said upper position while said holder is moved for carrying out said final bending process.

3. The hemming machine of claim 2 wherein said outer panel has a main body part and said flange is bent approximately perpendicularly from said main body, extending approximately vertically when said outer panel is placed on said lower block prior to said preliminary bending process; said mechanism moving said bending block nearly horizontally to approach said flange when said holder is moved for carrying out said preliminary bending process and nearly perpendicularly to the preliminary bent flange when said holder is moved for carrying out said final bending process.

4. The hemming machine of claim 3 wherein said mechanism causes said bending block to approach said flange for carrying out said preliminary bending process in a direction which makes an angle of 20–30° with said flange.

5. The hemming machine of claim 1 wherein said outer panel has a main body part and said flange is bent approximately perpendicularly from said main body, extending approximately vertically when said outer panel is placed on said lower block prior to said preliminary bending process;

said mechanism moving said bending block nearly horizontally to approach said flange when said holder is moved for carrying out said preliminary bending process and nearly perpendicularly to the preliminary bent flange when said holder is moved for carrying out said final bending process.

6. The hemming machine of claim 5 wherein said mechanism causes said bending block to approach said flange for carrying out said preliminary bending process in a direction which makes an angle of 20–30° with said flange.

7. The hemming machine of claim 1 wherein said preliminary bending surface faces downward and is sloped, being higher towards said lower block, and wherein said final bending surface is nearly horizontal and faces downward, said preliminary bending surface extending from said final bending surface towards said lower block.

8. The hemming machine of claim 1 wherein said preliminary bending surface faces downward and is sloped, being higher towards said lower block, and wherein said final bending surface is nearly horizontal and faces downward, said preliminary bending surface extending from said final bending surface towards said lower block.

* * * * *